US007013758B1

(12) United States Patent
Gendron

(10) Patent No.: US 7,013,758 B1
(45) Date of Patent: Mar. 21, 2006

(54) APPARATUS FOR REMOVING SHINGLES AND SHINGLE FASTENERS FROM A ROOF

(76) Inventor: Stephane Gendron, 1100 Cormier Street, Sorel-Tracy, Quebec (CA) J3R 1V8

( * ) Notice: Subject to any disclaimer, the term of this patent is extended or adjusted under 35 U.S.C. 154(b) by 20 days.

(21) Appl. No.: 10/962,408

(22) Filed: Oct. 13, 2004

(51) Int. Cl.
*E04D 15/00* (2006.01)
*B60B 1/06* (2006.01)

(52) U.S. Cl. ..... 81/45; 81/46; 301/70

(58) Field of Classification Search ..... 81/45, 81/46; 301/70, 170; 299/36.1, 37; 254/15
See application file for complete search history.

(56) References Cited

U.S. PATENT DOCUMENTS

| | | | | |
|---|---|---|---|---|
| 2,777,680 | A | | 1/1957 | Robb |
| 3,695,713 | A | | 10/1972 | Rothi et al. |
| 4,053,183 | A | | 10/1977 | Probst |
| 4,086,699 | A | | 5/1978 | Olkkola |
| 4,091,535 | A | | 5/1978 | Lehrter |
| 4,219,238 | A | | 8/1980 | Sanchez |
| 4,232,906 | A | | 11/1980 | Torbenson |
| 4,269,450 | A | * | 5/1981 | Welborn ..... 299/39.8 |
| 4,277,104 | A | | 7/1981 | Sanchez |
| 4,477,972 | A | | 10/1984 | Testa, Jr. |
| 4,663,995 | A | | 5/1987 | Amundson et al. |
| 4,664,447 | A | | 5/1987 | Clark |
| 4,691,439 | A | | 9/1987 | Marra |
| 4,699,430 | A | | 10/1987 | Nichols |
| 4,709,479 | A | | 12/1987 | Lavelette |
| 4,763,547 | A | | 8/1988 | Dike, Jr. |
| 5,001,946 | A | | 3/1991 | Shirlin et al. |
| 5,010,791 | A | | 4/1991 | Williams |
| 5,076,119 | A | * | 12/1991 | Wenz ..... 81/45 |
| 5,098,165 | A | * | 3/1992 | Jacobs et al. ..... 299/37.1 |
| 5,159,859 | A | | 11/1992 | Whitesell |
| 5,218,766 | A | * | 6/1993 | Himebaugh ..... 30/170 |
| 5,741,047 | A | | 4/1998 | Ordonez |
| 5,800,021 | A | * | 9/1998 | Derr ..... 299/37.1 |
| 5,921,155 | A | * | 7/1999 | Faller et al. ..... 81/45 |
| 6,029,545 | A | | 2/2000 | Harpell |
| 6,095,015 | A | | 8/2000 | Phelan |
| 6,105,470 | A | | 8/2000 | Hutchins |
| 6,116,117 | A | | 9/2000 | Nicolosi et al. |
| 6,128,979 | A | | 10/2000 | Shepherd |
| 6,257,094 | B1 | | 7/2001 | Babich |
| 6,393,948 | B1 | | 5/2002 | Hutchins |

* cited by examiner

*Primary Examiner*—Joseph J. Hail, III
*Assistant Examiner*—Alvin J. Grant

(57) ABSTRACT

An apparatus for removing shingles and shingle fasteners from a roof. The apparatus comprises a frame and a driver unit coupled to the frame, the driver unit including at least one motor. The apparatus also comprises a stripping unit coupled to the driver unit, the driver unit being operative to alternately move the stripping unit between two positions. The stripping unit is adapted to lift shingles off from a roof and to extract shingle fasteners out of the roof as the stripping unit alternately moves between the two positions and the apparatus moves on the roof. The apparatus further comprises a pair of cutters coupled to the driver unit, the driver unit being operative to drive the pair of cutters. The pair of cutters is adapted to cut shingles lifted off from the roof by the stripping unit to produce a strip of shingle material, the strip of shingle material including at least a portion of a first shingle connected to at least a portion of a second shingle by at least one shingle fastener extracted out of the roof by the stripping unit.

29 Claims, 9 Drawing Sheets

APPARATUS FOR REMOVING SHINGLES AND SHINGLE FASTENERS FROM A ROOF

FIELD OF THE INVENTION

The present invention relates to removal of roofing material and, more particularly, to an apparatus for removing shingles and shingle fasteners from a roof.

BACKGROUND OF THE INVENTION

Manual removal of roofing material, including shingle and shingle fasteners, from a roof is a physically demanding process. Workers involved in such manual removal often suffer from pain and/or injuries in particular to their backs, arms and elbows as a result of the removal process.

Apparatuses have been developed for mechanically removing roofing material from a roof in an effort to mitigate the deleterious effects of manual removal of roofing material. However, existing apparatuses suffer from multiple drawbacks. For instance, existing apparatuses typically strip pieces of shingles off from a roof in a somewhat random fashion whereby the stripped pieces of shingles randomly accumulate on the apparatuses and/or randomly drop back onto the roof in a disorganized manner. This random and disorganized removal process typically results in frequent interruptions of the removal process and/or requires increased effort for gathering and disposing of the removed roofing material.

Accordingly, there is a need in the industry for improvements in apparatuses for removing shingles and shingle fasteners from a roof.

SUMMARY OF THE INVENTION

In accordance with a first broad aspect, the invention provides an apparatus for removing shingles and shingle fasteners from a roof. The apparatus comprises a frame and a driver unit coupled to the frame, the driver unit including at least one motor. The apparatus also comprises a stripping unit coupled to the driver unit, the driver unit being operative to alternately move the stripping unit between two positions. The stripping unit is adapted to lift shingles off from a roof and to extract shingle fasteners out of the roof as the stripping unit alternately moves between the two positions and the apparatus moves on the roof. The apparatus further comprises a pair of cutters coupled to the driver unit, the driver unit being operative to drive the pair of cutters. The pair of cutters is adapted to cut shingles lifted off from the roof by the stripping unit to produce a strip of shingle material, the strip of shingle material including at least a portion of a first shingle connected to at least a portion of a second shingle by at least one shingle fastener extracted out of the roof by the stripping unit.

In accordance with a second broad aspect, the invention provides a method for removing shingles and shingle fasteners from a roof. The method comprises lifting shingles off from a roof and extracting shingle fasteners out of the roof using a stripping unit alternately moving between two positions. The method also comprises cutting the shingles lifted off from the roof by the stripping to produce a strip of shingle material, the strip of shingle material including at least a portion of a first shingle connected to at least a portion of a second shingle by at least one shingle fastener extracted out of the roof by the stripping unit.

These and other aspects and features of the present invention will now become apparent to those of ordinary skill in the art upon review of the following description of specific embodiments of the invention in conjunction with the accompanying drawings.

BRIEF DESCRIPTION OF THE DRAWINGS

A detailed description of specific embodiments of the present invention is provided herein below, by way of example only, with reference to the accompanying drawings, in which.

Figure 1A:
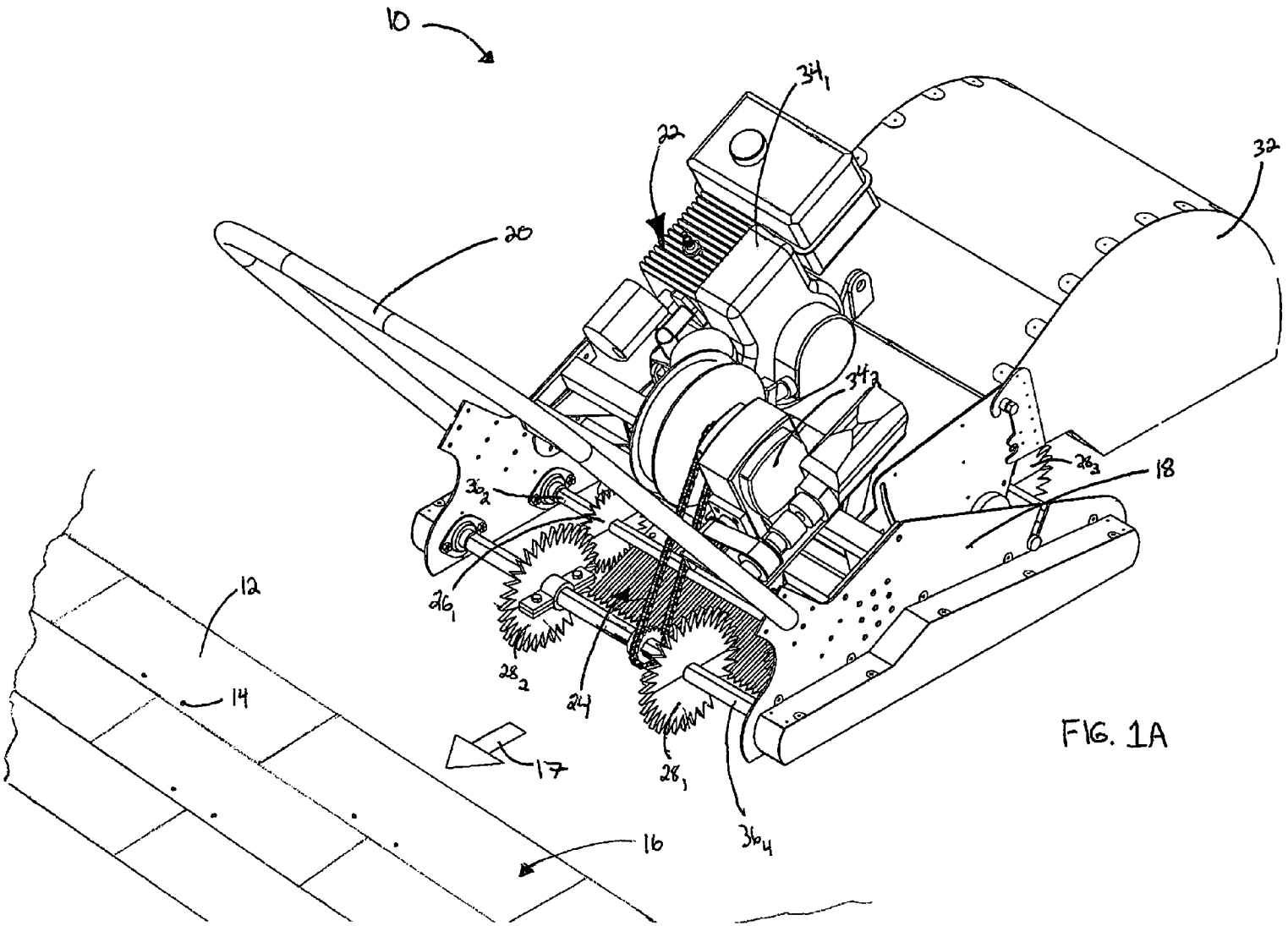
FIG. 1A is a diagrammatic perspective view of an apparatus for removing shingles and shingle fasteners from a roof, in accordance with a first specific example of implementation of the present invention.
Figures 1B, 1C:
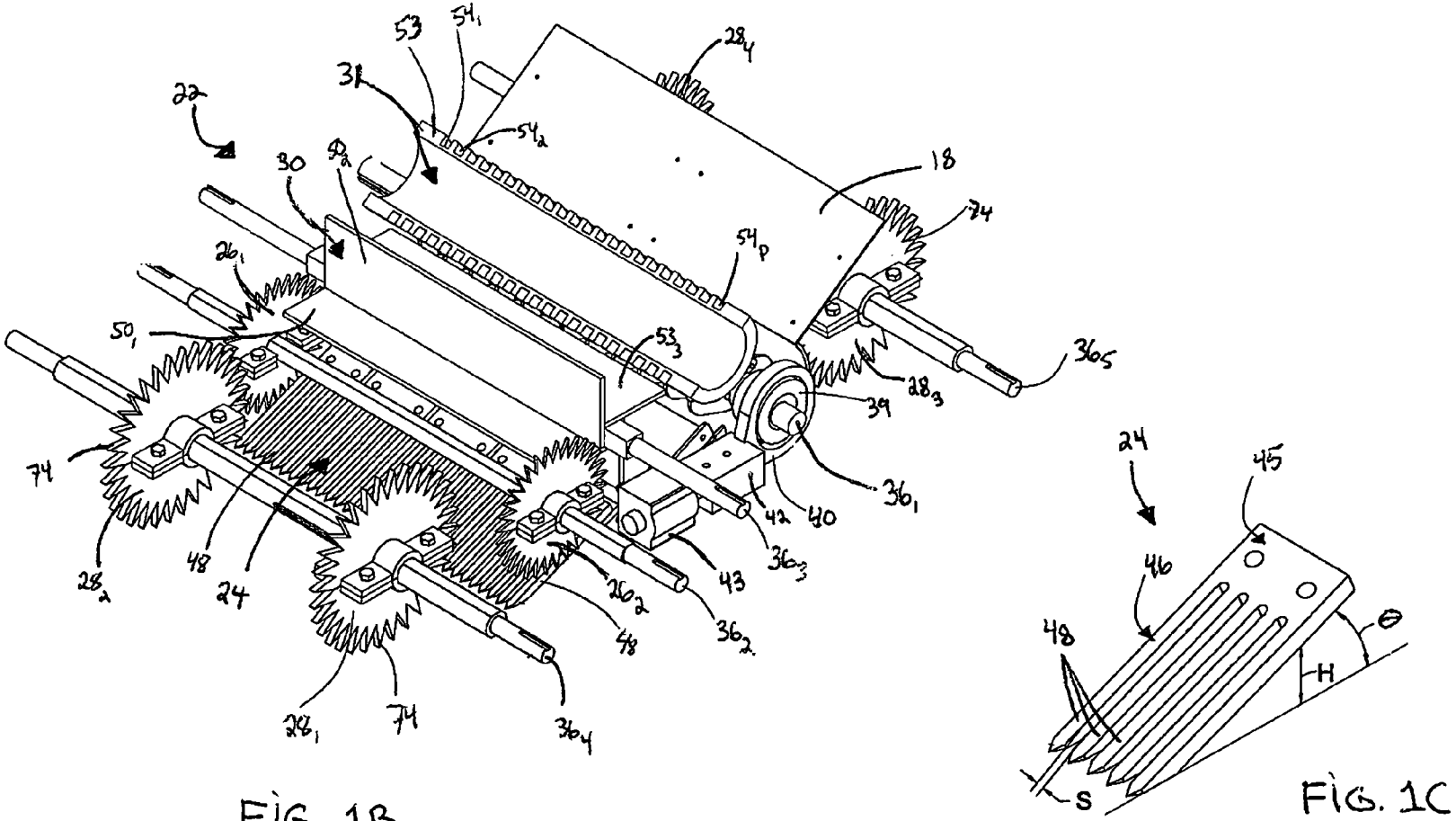
FIG. 1B is a diagrammatic perspective view showing a driver unit, a stripping unit, a pair of cutters, a pulling unit, and a shredding unit of the apparatus shown in FIG. 1A.
FIG. 1C is a diagrammatic perspective view of a portion of the stripping unit of the apparatus shown in FIGS. 1A and 1B.
Figures 1D, 1F:
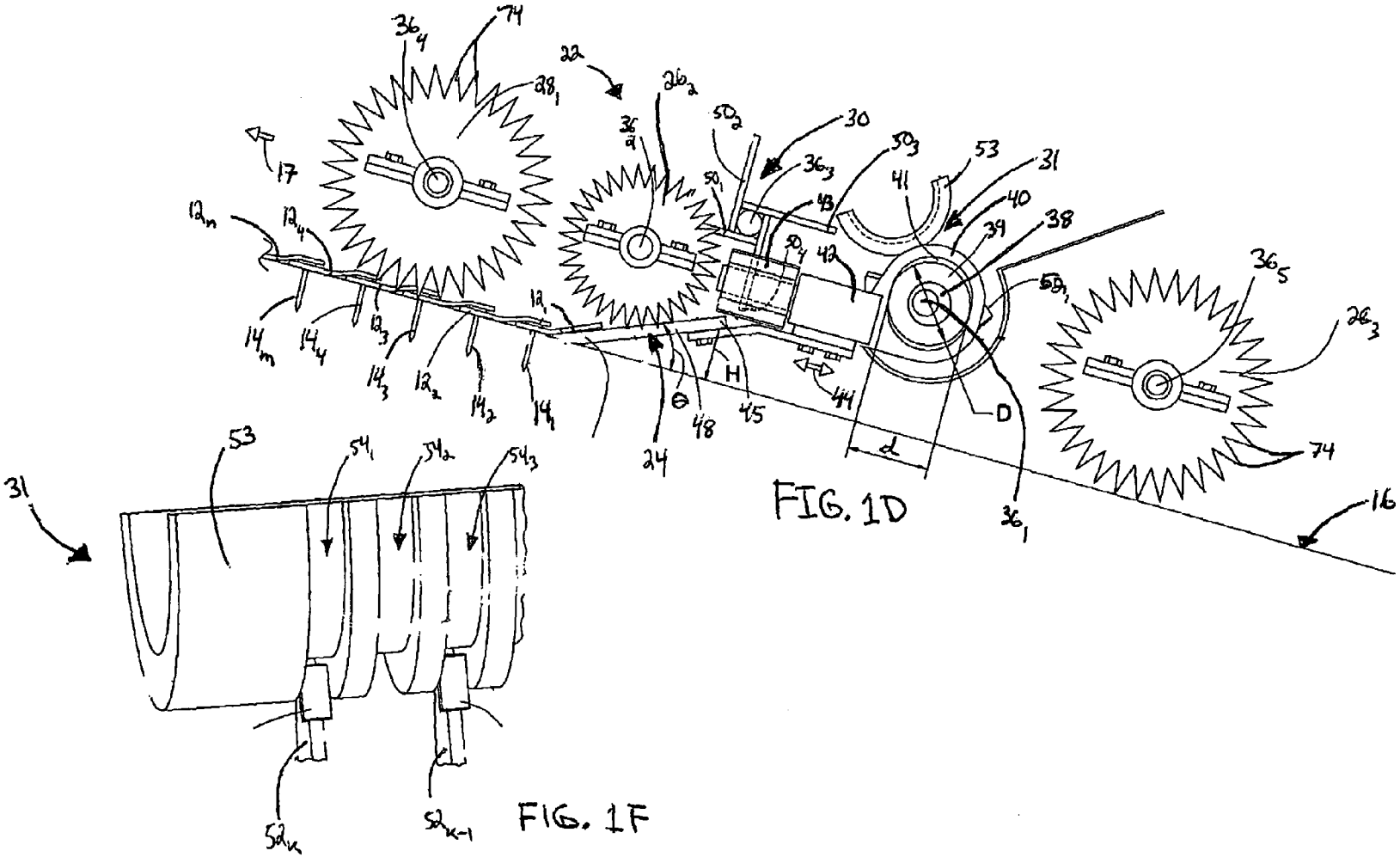
FIG. 1D is a diagrammatic side elevation view of the driver unit, the stripping unit, the pair of cutters, the pulling unit, and the shredding unit of the apparatus shown in FIGS. 1A and 1B.
FIG. 1F is a diagrammatic perspective view of a portion of the shredding unit of the apparatus shown in FIGS. 1A, 1B and 1E.

In the drawings, the embodiments of the invention are illustrated by way of examples. It is to be expressly understood that the description and drawings are only for the purpose of illustration and are an aid for understanding. They are not intended to be a definition of the limits of the invention.

DETAILED DESCRIPTION

FIGS. 1A to 1F show an apparatus 10 for removing shingles $\mathbf{12}_1 \ldots \mathbf{12}_n$ and shingle fasteners $\mathbf{14}_1 \ldots \mathbf{14}_m$ from a roof 16, in accordance with a first specific example of implementation of the present invention. The apparatus 10 comprises a frame 18, a driver unit 22, a stripping unit 24, and a pair of cutters $\mathbf{26}_1$ and $\mathbf{26}_2$. In this specific example of implementation, the apparatus 10 also optionally comprises a steering unit 20, a set of traction wheels $\mathbf{28}_1 \ldots \mathbf{28}_4$, a pulling unit 30, a shredding unit 31, and a shingle material collector 32.

As described in further detail below, when the apparatus 10 moves on the roof 16 in a given direction 17, the driver unit 22, the stripping unit 24, and the pair of cutters 26 interact to lift the shingles $\mathbf{12}_1 \ldots \mathbf{12}_n$ off from the roof 16 and to extract the shingles fasteners $\mathbf{14}_1 \ldots \mathbf{14}_m$ out of the roof 16 in such a manner as to produce a "continuous" strip of shingle material. The strip of shingle material includes a plurality of shingle portions of the shingles $\mathbf{12}_1 \ldots \mathbf{12}_n$ that have been lifted off from the roof 16 and that are interconnected by one or more of the shingle fasteners $\mathbf{14}_1 \ldots \mathbf{14}_m$ that have been extracted out of the roof 16. Each shingle portion of the plurality of shingle portions in the strip of shingle material either includes an entire one of the shingles $\mathbf{12}_1 \ldots \mathbf{12}_n$ or includes only a portion of one of the shingles $\mathbf{12}_1 \ldots \mathbf{12}_n$.

Advantageously, the production of the strip of shingle material facilitates handling and disposal of the shingles $\mathbf{12}_1 \ldots \mathbf{12}_n$ and the shingles fasteners $\mathbf{14}_1 \ldots \mathbf{14}_m$ as they are removed from the roof 16. In the non-limiting example of implementation shown in FIGS. 1A to 1F, the strip of shingle material is fed to the shredding unit 31 where it is shred to pieces that are collected in the shingle material collector 32. In other examples of implementation, the shredding unit 31 and the shingle material collector 32 are not included, in which case the strip of shingle material can be handled in various possible manners. For instance, the strip of shingle material can emerge through an outlet of the apparatus 10 and can be manually disposed of (as described below in connection with FIGS. 2A, 2B, 3A and 3B).

With continued reference to FIGS. 1A to 1F, the steering unit 20 is coupled to the frame 18 and is adapted to enable a user to steer the apparatus 10 on the roof 16. Advantageously, the steering unit 20 can be adapted to acquire a compact configuration to reduce the space required for storing and/or transporting the apparatus 10 when not in use. For example, the steering unit 20 can be adapted to acquire a compact configuration by being folded onto itself (as described below in connection with FIGS. 2A and 2B).

The driver unit 22 is coupled to the frame 18 and is operative to drive the stripping unit 24 and the pair of cutters $\mathbf{26}_1$ and $\mathbf{26}_2$. In this specific example of implementation, the driver unit 22 is also operative to drive the pulling unit 30, the traction wheels $\mathbf{28}_1 \ldots \mathbf{28}_4$, and the shredding unit 31.

The driver unit 22 includes at least one motor and driving elements coupling the at least one motor to the stripping unit 24, the pair of cutters 26, and 262, the pulling unit 30, the traction wheels $\mathbf{28}_1 \ldots \mathbf{28}_4$, and the shredding unit 31. In the non-limiting example of implementation shown, the at least one motor includes a first motor 34, and a second motor $\mathbf{34}_2$, which can each be an internal combustion engine or an electric motor. If an electric motor is used, it can be powered by an electric cable connecting it to an electrical outlet or by a battery pack directly coupled to the electric motor. Also, in this non-limiting example of implementation, the driving elements include a plurality of shafts $\mathbf{36}_1 \ldots \mathbf{36}_5$ and mechanical links.

Although the driving elements of the driver unit 22 in the example of implementation of FIGS. 1A to 1F are purely mechanical, it is to be understood that various other types of elements, such as pneumatic, hydraulic, or electromechanical elements, can also be used to implement the driver unit 22 without departing from the scope of the present invention.

With particular reference to FIGS. 1A to 1D, the stripping unit 24 is coupled to the driver unit 22. The driver unit 22 is operative to alternately move the stripping unit 24 between two positions. The stripping unit 24 is adapted to lift the shingles $\mathbf{12}_1 \ldots \mathbf{12}_n$ off from the roof 16 and to extract the shingles fasteners $\mathbf{14}_1 \ldots \mathbf{14}_m$ out of the roof 16 as the stripping unit 24 alternately moves between the two positions and the apparatus 10 moves on the roof 16. That is, as the apparatus 10 moves on the roof 16 in the direction 17, the configuration and the alternating motion of the stripping unit 24 causes the stripping unit 24 to progressively lift the shingles $\mathbf{12}_1 \ldots \mathbf{12}_n$ off from the roof 16 and extract the shingles fasteners $\mathbf{14}_1 \ldots \mathbf{14}_m$ out of the roof 16.

In the particular example of implementation shown, the alternating motion of the stripping unit 24 is generated by the driver unit 22 as follows. The first motor 34, is coupled to the shaft $\mathbf{36}_1$, and is operative to rotate the shaft $\mathbf{36}_1$ about its axis. An offset fitting 38 is secured on an end portion of the shaft $\mathbf{36}_1$ and a bearing 39 is rollably mounted on the offset fitting 38. Furthermore, a link 40 is provided with an opening 41 and an arm 42, the arm 42 being received and free to move in a linear bearing 43 secured to the frame 18. The opening 41 has a small dimension d generally corresponding to a diameter D of the bearing 39. Although not shown in FIGS. 1A to 1D, a similar offset fitting-bearing-link-linear bearing assembly is mounted at the other end portion of the shaft 361.

Rotation of the first shaft 36, by the first motor 34, results in rotation of the offset fitting 38, which in turn moves the bearing 39. The movement of the bearing 39 in turn causes a reciprocating motion (as indicated by arrow 44 in FIG. 1D) of the arm 42 of the link 41, which is kept in line by the linear bearing 43. The stripping unit 24 is coupled to the arm 42 and is thus also reciprocated.

In the non-limiting example of implementation of FIGS. 1A to 1D, the stripping unit 24 has an upper section 45 coupled to arm 42 and a lower section 46 defining a series of teeth 48 generally adjacent and parallel to each other. In this example of implementation, the series of teeth 48 define a plane at a non-zero angle 0 relative to the roof 16 such as to enable the teeth 48 to reach under the shingles $\mathbf{12}_1 \ldots \mathbf{12}_n$ and lift the shingles $\mathbf{12}_1 \ldots \mathbf{12}_n$ off from the roof 16 and extract the shingle fasteners $\mathbf{14}_1$-$\mathbf{14}_m$ out of the roof.

In the example of implementation shown, the shingle fasteners $\mathbf{14}_1 \ldots \mathbf{14}_m$ are nails. Advantageously, the distance H between the teeth 48 at a location adjacent the upper section 45 and the roof 16 is greater than or equal to the length of a standard shingle nail. Also, the spacing S between adjacent ones of the teeth 48 is greater than the diameter of a shank of the nails $\mathbf{14}_1, \ldots \mathbf{14}_m$ but less than the width of a head of the nails $\mathbf{14}_1 \ldots \mathbf{14}_m$. It is to be understood, however, that the shingle fasteners $\mathbf{14}_1 \ldots \mathbf{14}_m$ can be nails, staples or any other fasteners used for fixing shingles on a roof, and that the apparatus 10 of the present invention can be used to remove shingles fixed on a roof with any type of shingle fasteners.

It will be appreciated that FIGS. 1A to 1D illustrate one possible example of implementation of the stripping unit 24 and that various other implementations are possible for the stripping unit 24 without departing from the scope of the present invention. Furthermore, while in the example of implementation of FIGS. 1A to 1D the driver unit 22 is adapted to impart a rectilinear reciprocating motion to the stripping unit 24, it is to be understood that, generally, the driver unit 22 can be adapted to impart any alternating motion of the stripping unit 24 between two positions. For instance, in other examples of implementation, the driver unit 22 can be adapted to alternately pivot the stripping unit 24 between two positions. In yet other examples of implementation, the driver unit 22 can be adapted to alternately move the stripping unit 24 between two positions along a path having a rectilinear portion and a curvilinear portion.

With continued reference to FIGS. 1A to 1D, the cutters $\mathbf{26}_1$ and $\mathbf{26}_2$ are coupled to the driver unit 22, the driver unit 22 being operative to drive the cutters $\mathbf{26}_1$ and $\mathbf{26}_2$. The cutters $\mathbf{26}_1$ and $\mathbf{26}_2$ are adapted to cut the shingles $\mathbf{12}_1 \ldots \mathbf{12}_n$ lifted off from the roof 16 by the stripping unit 22 to produce a strip of shingle material. As mentioned previously, the strip of shingle material includes a plurality of shingle portions of the shingles $\mathbf{12}_1 \ldots \mathbf{12}_n$ that have been lifted off from the roof 16 and that are interconnected by one or more of the shingle fasteners $\mathbf{14}_1 \ldots \mathbf{14}_m$ that have been extracted out of the roof 16. Each shingle portion of the plurality of shingle portions in the strip of shingle material either includes an entire one of the shingles $\mathbf{12}_1 \ldots \mathbf{12}_n$ or includes only a portion of one of the shingles $\mathbf{12}_1 \ldots \mathbf{12}_n$.

While it is possible that the strip of shingle material produced by the apparatus 10 includes shingle portions of all of the shingles $\mathbf{12}_1 \ldots \mathbf{12}_n$ interconnected by multiple ones of the shingle fasteners $\mathbf{14}_1 \ldots \mathbf{14}_m$, the apparatus 10 will be deemed to operate satisfactorily if the strip of shingle material produced includes at least a portion of a first shingle of the shingles $\mathbf{12}_1 \ldots \mathbf{12}_n$ that is connected to at least a portion of a second shingle of the shingles $\mathbf{12}_1 \ldots \mathbf{12}_n$ by at least one shingle fastener of the shingle fasteners $\mathbf{14}_1 \ldots \mathbf{14}_m$ extracted out of the roof 16 by the stripping unit 24. For instance, the apparatus 10 would be deemed to operate satisfactorily if the strip of shingle material included at least a portion of the shingle $\mathbf{12}_1$ that is connected to at least a portion of the shingle $\mathbf{12}_2$ by the shingle fastener $\mathbf{14}_1$. In the specific example of implementation shown, each one of the cutters $\mathbf{26}_1$ and $\mathbf{26}_2$ is a rotary cutter coupled to the shaft $\mathbf{36}_2$. The second motor $\mathbf{34}_2$ is coupled to the shaft $\mathbf{36}_2$ and is operative to rotate the shaft $\mathbf{36}_2$ about its axis, thereby rotating the cutters $\mathbf{26}_1$ and $\mathbf{26}_2$. The cutters $\mathbf{26}_1$ and $\mathbf{26}_2$ are spaced apart from each other by a certain distance such that the strip of shingle material has a width substantially corresponding to the certain distance between the cutters $\mathbf{26}_1$ and $\mathbf{26}_2$. In this particular embodiment, the distance between the cutters $\mathbf{26}_1$ and $\mathbf{26}_2$ is such that the stripping unit 24 is positioned between the cutters $\mathbf{26}_1$ and $\mathbf{26}_2$. Advantageously, the position of the shaft $\mathbf{36}_2$ relative to the frame 18 is adjustable to select the position at which the cutters $\mathbf{26}_1$ and $\mathbf{26}_2$ begin to cut the shingles $\mathbf{12}_1 \ldots \mathbf{12}_n$ lifted off from the roof 16 by the stripping unit 22 to produce the strip of shingle material.

Although in the specific example of implementation of FIGS. 1A to 1D the cutters are rotary cutters, it will be appreciated that the cutters $\mathbf{26}_1$ and $\mathbf{26}_2$ can be implemented using various other types of cutters without departing from the scope of the present invention.

With continued reference to FIGS. 1A to 1D, the pulling unit 30 is coupled to the driver unit 22, the driver unit 22 being operative to rotate the pulling unit 30. The pulling unit 30 in rotation is operative to pull the strip of shingle material away from the pair of cutters $\mathbf{26}_1$ and $\mathbf{26}_2$.

In the specific example of implementation shown, the pulling unit 30 is coupled to the shaft $\mathbf{36}_3$. The second motor $\mathbf{34}_2$ is coupled to the shaft $\mathbf{36}_3$ and is operative to rotate the shaft $\mathbf{36}_3$ about its axis, thereby rotating the pulling unit 30. In this particular embodiment, the pulling unit 30 includes a plurality of arms $\mathbf{50}_1 \ldots \mathbf{50}_4$ adapted to sequentially engage and pull the strip of shingle material as the pulling unit 30 rotates. The arms $\mathbf{50}_1 \ldots \mathbf{50}_4$ are configured to extend substantially the entire distance between the pair of cutters $\mathbf{26}_1$ and $\mathbf{26}_2$.

Advantageously, the pulling unit 30 acts as a guide to direct the strip of shingle material being produced away from the pair of cutters $\mathbf{26}_1$ and $\mathbf{26}_2$ and into a specific direction relative to the frame 18. In the non-limiting example of implementation shown in FIGS. 1 to 6, the pulling unit 30 directs the strip of shingle material to the shredding unit 31.

As another advantage, the pulling unit 30 in rotation being operative to pull the strip of shingle material away from the pair of cutters $\mathbf{26}_1$ and $\mathbf{26}_2$ generates a force for moving the apparatus 10 in the direction 17 on the roof 16. That is, the pulling force exerted by the pulling unit 30 on the strip of shingle material represents a force that tends to move the apparatus 10 in the direction 17 on the roof 16. In other words, the pulling unit 30 uses the shingle materials to be removed from the roof 16 to move, or at least contribute to the motion of, the apparatus 10 in the direction 17 on the roof 16.

It will be appreciated that FIGS. 1A to 1D illustrate one possible example of implementation of the pulling unit 30 and that various other implementations are possible for the pulling unit 30 without departing from the scope of the present invention.

With reference to FIGS. 1A to 1F, the shredding unit 31 is operative to shred the strip of shingle material produced by the stripping unit 24 and the pair of cutters $\mathbf{26}_1$ and $\mathbf{26}_2$. In the particular example of implementation shown, the shredding unit 31 includes a plurality of blades $\mathbf{52}_1 \ldots \mathbf{52}_k$ connected to the shaft 36, and a barrier 53 defining a plurality of grooves $\mathbf{54}_1 \ldots \mathbf{54}_p$ each registering with a respective one of the plurality of blades $\mathbf{52}_1 \ldots \mathbf{52}_k$. Rotation of the first shaft $\mathbf{36}_1$ by the first motor $\mathbf{34}_1$ rotates the plurality of blades $\mathbf{52}_1 \ldots \mathbf{52}_k$ into the plurality of grooves $\mathbf{54}_1 \ldots \mathbf{54}_p$ so as to shred the strip of shingle material, including the shingle fasteners $\mathbf{14}_1 \ldots \mathbf{14}_m$ extracted from the roof 16.

Figure 1E:
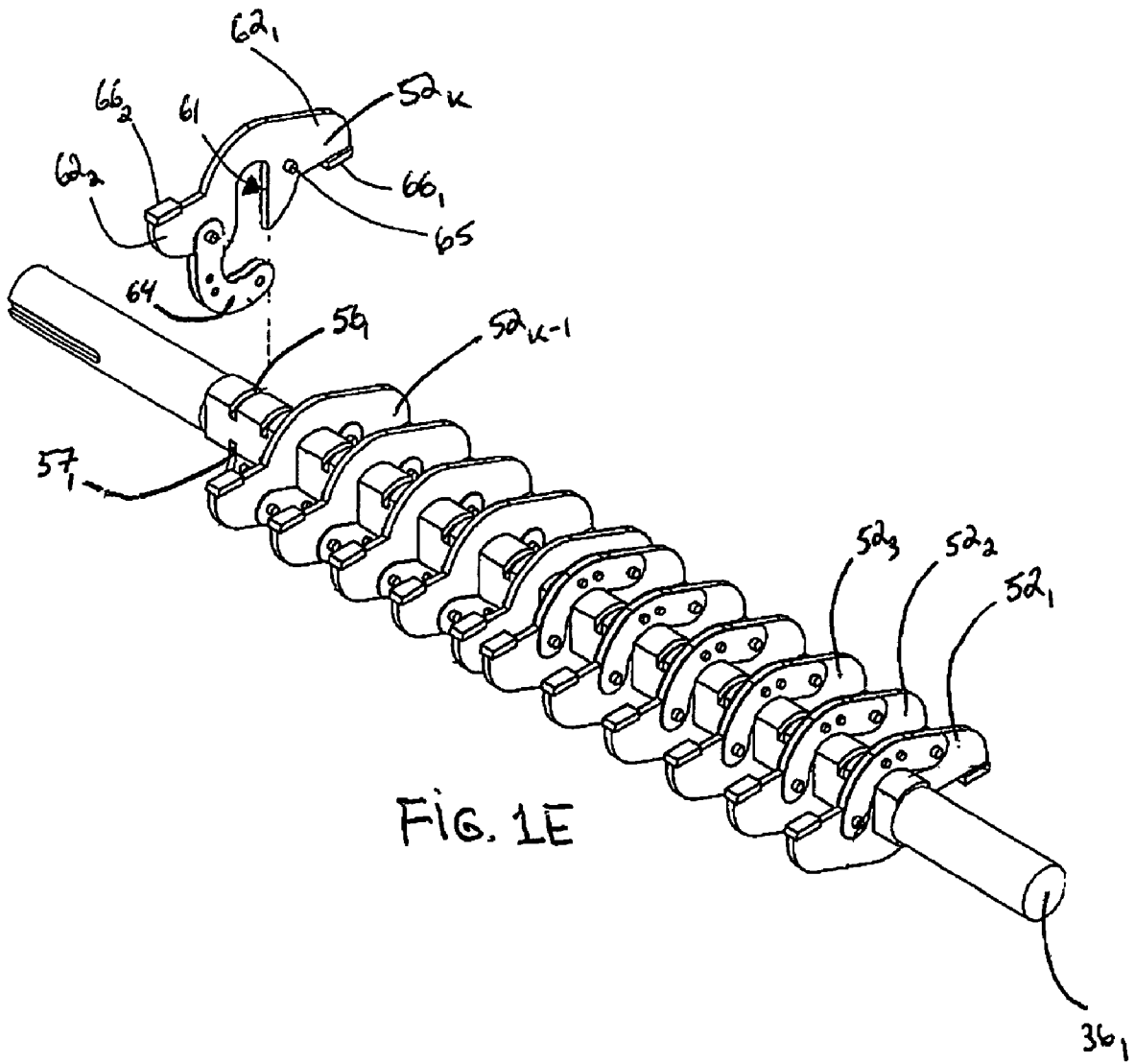
FIG. 1E is a diagrammatic perspective view of a component of the shredding unit of the apparatus shown in FIGS. 1A and 1B.

In the specific example of implementation shown in FIGS. 1A to 1F, the plurality of blades $\mathbf{52}_1 \ldots \mathbf{52}_k$ are removably connected to the shaft 361. More specifically, as shown in FIG. 1E, the shaft $\mathbf{36}_1$ defines a first series of grooves $\mathbf{56}_1 \ldots \mathbf{56}_q$ and a second series of grooves $\mathbf{57}_1 \ldots \mathbf{57}_q$. Each one of the grooves $\mathbf{56}_1 \ldots \mathbf{56}_q$ is in register with a respective one of grooves $\mathbf{57}_1 \ldots \mathbf{57}_q$ for receiving a respective one of the blades $\mathbf{52}_1 \ldots \mathbf{52}_k$. Each one of the blades $\mathbf{52}_1 \ldots \mathbf{52}_k$ defines a U-shaped opening 61 and has a first arm $\mathbf{62}_1$, a second arm $\mathbf{62}_2$, a first cutting tool $\mathbf{66}_1$ or the like mounted on an end portion of the first arm $\mathbf{62}_1$, and a second cutting tool $\mathbf{66}_2$ or the like mounted on an end portion of the second arm $\mathbf{62}_2$. Each one of the blades $\mathbf{52}_1 \ldots \mathbf{52}_k$ also has an extension 64 pivotable between an open position and a closed position. In the open position, the extension 64 of a particular blade of the blades $\mathbf{52}_1 \ldots \mathbf{52}_k$ allows the particular blade to be mounted on or removed from the shaft $\mathbf{36}_1$. A locking element 65 is adapted to lock the extension 64 in the closed position to secure the particular blade on the shaft $\mathbf{36}_1$.

Figure 1G:
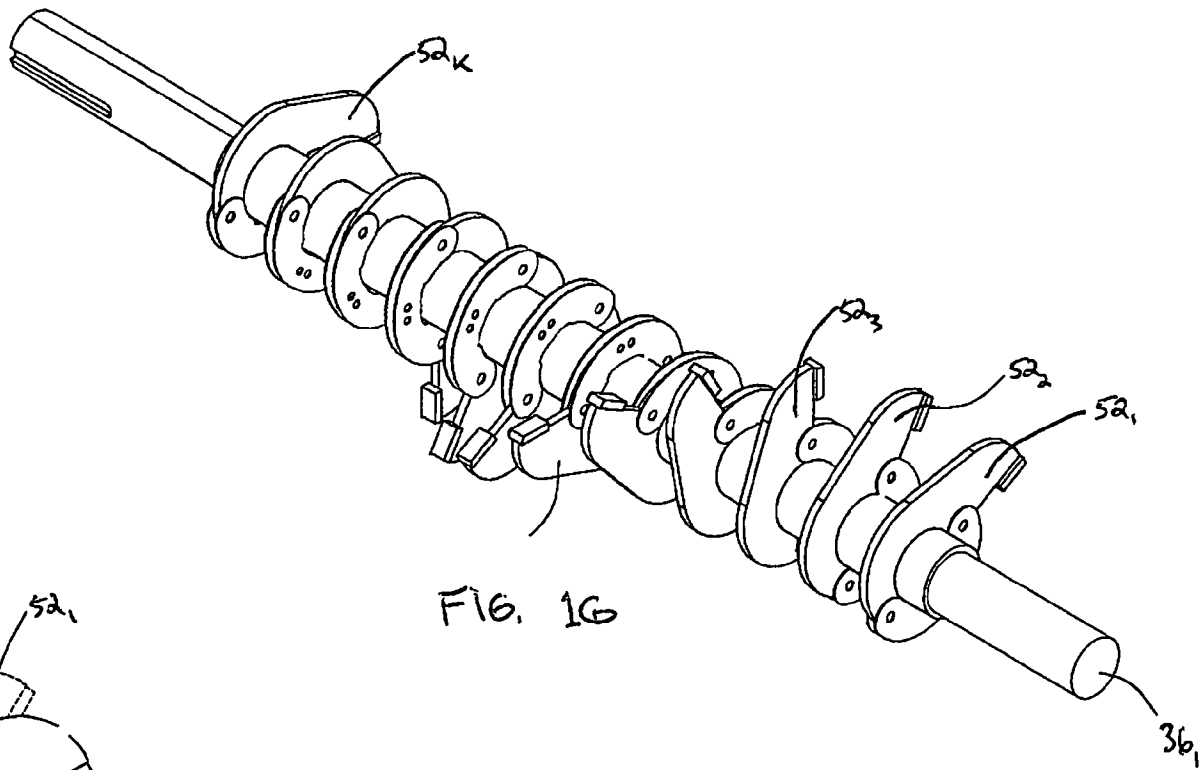
FIG. 1G is a diagrammatic perspective view of a variant example of implementation of the component of the shredding unit of the apparatus shown in FIG. 1E.
Figure 1H:
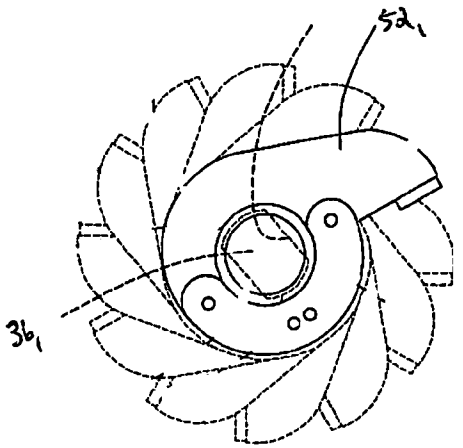
FIG. 1H is a diagrammatic end elevation view of the component of the shredding unit of the apparatus shown in FIG. 1G.

FIGS. 1G and 1H illustrate a variant example of implementation for the blades $\mathbf{52}_1 \ldots \mathbf{52}_k$ and their arrangement on the shaft $\mathbf{36}_1$. In this example of implementation, each one of the blades $\mathbf{52}_1 \ldots \mathbf{52}_k$ only has a first arm $\mathbf{62}_1$ and a first cutting tool $\mathbf{66}_1$ or the like mounted on an end portion of the first arm $\mathbf{62}_1$. Furthermore, the first series of grooves $\mathbf{56}_1 \ldots \mathbf{56}_q$ and the second series of grooves $\mathbf{57}_1 \ldots \mathbf{57}_q$ are circumferentially spaced apart such that the blades $52_1 \ldots 52_k$ are mounted on the shaft 36, so as to collectively define a helix configuration.

It will be appreciated that FIGS. 1A to 1H illustrate one possible example of implementation of the shredding unit 31 and that various other implementations are possible for the shredding unit 31 without departing from the scope of the present invention.

With reference to FIGS. 1A to 1D, the shingle material collector 32 is removably coupled to the frame 18 and is adapted to collect shredded material produced by the shredding unit 31. The shingle material collector 32 can be implemented using a container having an opening for receiving the shredded material produced by the shredding unit 31.

Finally, with continued reference to FIGS. 1A to 1D, each one of the traction wheels $28_1 \ldots 28_4$ is coupled to the driver unit 22. The driver unit 22 is operative to drive each one of the traction wheels $28_1 \ldots 28_4$ to move the apparatus 10 in the direction 17 on the roof 16. In the particular example of implementation shown, the traction wheels $28_1$ and $28_2$ are coupled to the shaft $36_4$ and the traction wheels $28_3$ and $28_4$ are coupled to the shaft $36_5$. The second motor $34_2$ is coupled to the shafts $36_4$ and $36_5$ and is operative to rotate the shafts $36_4$ and $36_5$ about their respective axis, thereby driving the traction wheels $28_1 \ldots 28_4$. Advantageously, each one of the traction wheels $28_1 \ldots 28_4$ is provided with a plurality of wheel teeth 74 to enhance traction of the traction wheels $28_1 \ldots 28_4$ on the roof 16.

It will thus be appreciated that the various components of the apparatus 10 interact in order to efficiently remove the shingles $12_1 \ldots 12_n$ and the shingle fasteners $14_1 \ldots 14_m$ from the roof 16 and to facilitate disposal of the removed material. The apparatus 10 is positioned at a lower level on the roof 16 with the teeth 48 of the stripping unit 24 wedged between at least a first shingle, say the shingle $12_1$, of the shingles $12_1 \ldots 12_n$ to be removed and the roof 16. Through activation of the first and second motors $34_1$ and $34_2$, the driver unit 22 is activated in order to drive the stripping unit 24, the pair of cutters $26_1$ and $26_2$, the pulling unit 30, the traction wheels $28_1 \ldots 28_4$, and the shredding unit 31.

The driven traction wheels $28_1 \ldots 28_4$ move the apparatus 10 in the direction 17 on the roof 16, the steering unit 20 enabling a user to steer the apparatus in the desired direction 17. As the apparatus 10 moves on the roof 16, the reciprocating motion of the stripping unit 24 imparted by the driver unit 22 causes the stripping unit 24 to progressively separate and lift the shingles $12_1 \ldots 12_n$ off from the roof 16 and to extract the shingle fasteners $14_1 \ldots 14_m$ out of the roof 16. At the same time, the pair of cutters $26_1$ and $26_2$ driven by the driver unit 22 continuously cut the shingles $12_1 \ldots 12_n$ lifted off from the roof 16 by the stripping unit 22 to produce a strip of shingle material. The pulling unit 30 rotated by the driver unit 22 pulls on the strip of shingle material such as to direct the strip of shingle material away from the pair of cutters $26_1$ and $26_2$ and towards the shredding unit 31. Advantageously, the pulling force exerted by the pulling unit 30 on the strip of shingle material represents a force that tends to move the apparatus 10 in the direction 17 on the roof 16. Finally, the shredding unit 31 shreds the strip of shingle material into pieces that are collected in the shingle material collector 32.

Figure 2A:
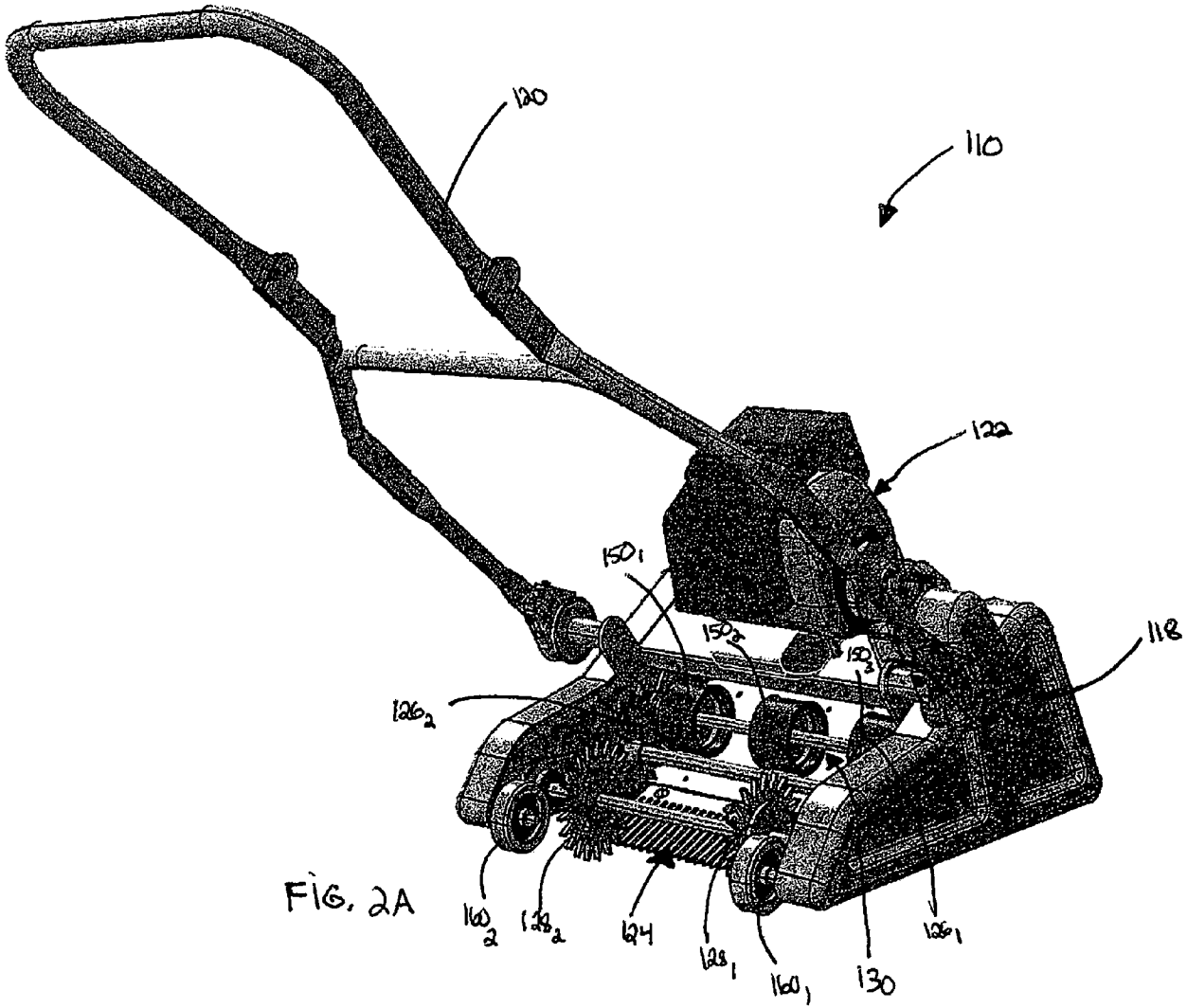
FIG. 2A is a diagrammatic front perspective view of an apparatus for removing shingles and shingle fasteners from a roof, in accordance with a second specific example of implementation of the present invention.
Figure 2B:
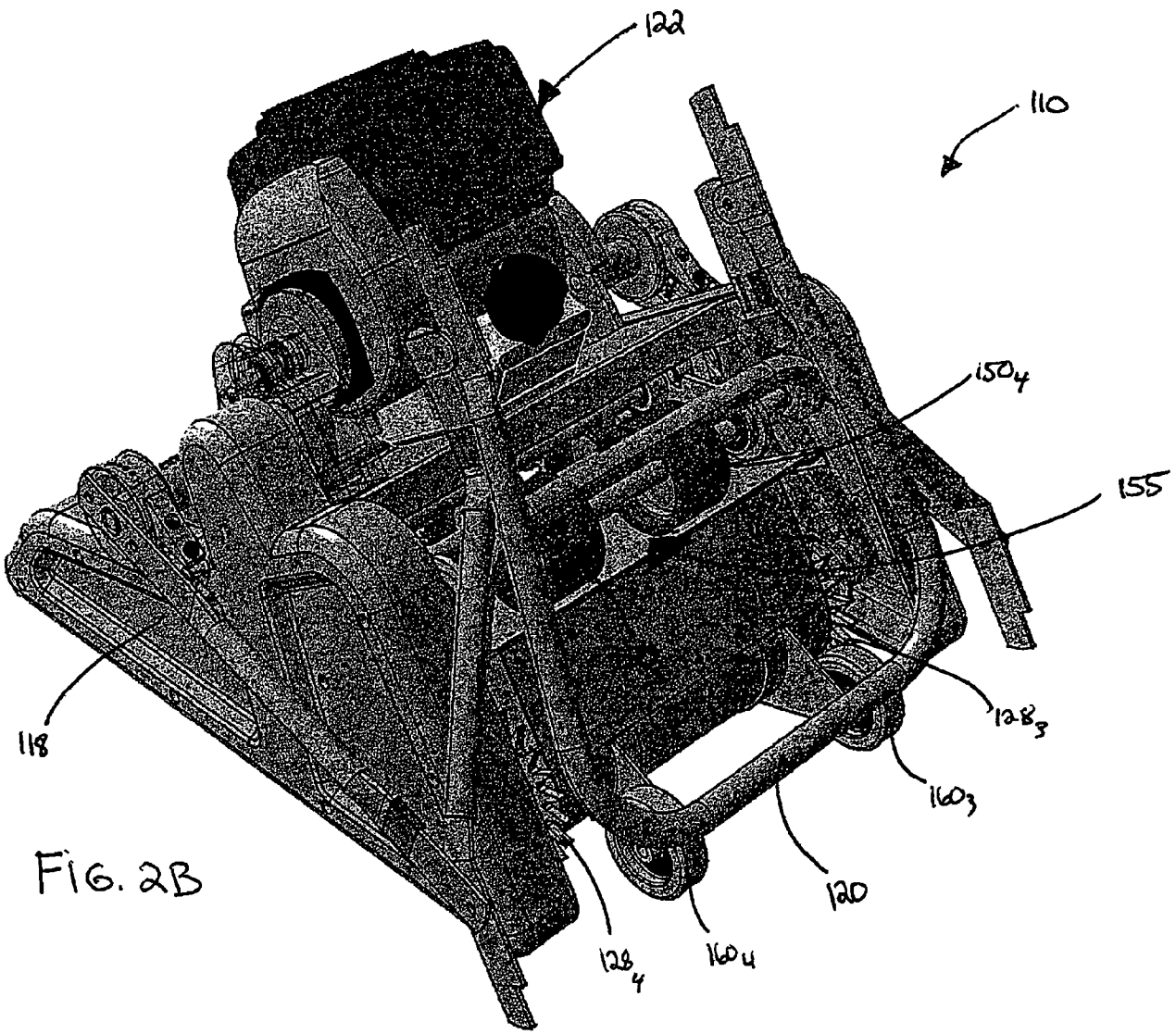
FIG. 2B is a diagrammatic rear perspective view of the apparatus shown in FIG. 2A, with a steering unit of the apparatus in a compact configuration.

FIGS. 2A and 2B show an apparatus 110 for removing shingles $12_1 \ldots 12_n$ and shingle fasteners $14_1 \ldots 14_m$ from a roof 16, in accordance with a second specific example of implementation of the present invention. The apparatus 110 comprises a frame 118, a steering unit 120, a driver unit 122, a stripping unit 124, and a pair of cutters $126_1$ and $126_2$. In this specific example of implementation, the apparatus 110 also optionally comprises a set of traction wheels $128_1 \ldots 128_4$ and a pulling unit 130. The frame 118, the steering unit 120, the driver unit 122, the stripping unit 124, the pair of cutters $126_1$ and $126_2$, the set of traction wheels $128_1 \ldots 128_4$, and the pulling unit 130 have the same function as the frame 18, the steering unit 20, the driver unit 22, the stripping unit 24, the pair of cutters $26_1$ and $26_2$, the set of traction wheels $28_1 \ldots 28_4$ and the pulling unit 30, respectively, of the apparatus 10 described previously in connection with FIGS. 1A to 1D.

In the example of implementation of FIGS. 2A and 2B, the steering unit 120 is adapted to acquire a compact configuration to reduce the space required for storing and/or transporting the apparatus 110 when not in use. As shown in FIG. 2B, the steering unit 120 is adapted to acquire a compact configuration by being folded onto itself. Furthermore, in this specific example of implementation, the pulling unit 130 includes a plurality of rollers $150_1 \ldots 150_5$ adapted to contact and pull the strip of shingle material as the pulling unit 130 is driven by the driver unit 122. The apparatus 110 also includes a set of wheels $160_1 \ldots 160_4$ rotatably coupled to the frame 118 to allow the apparatus 110 to be rollably moved on the roof 16 or any other surface.

In this particular embodiment, the strip of shingle material is guided by the pulling unit 130 so as to exit through an outlet 155 of the apparatus 110. The strip of shingle material then falls back onto the roof 16 where it can be simultaneously or subsequently rolled up into a roll of shingle material by manual means, for example.

Figure 3A:
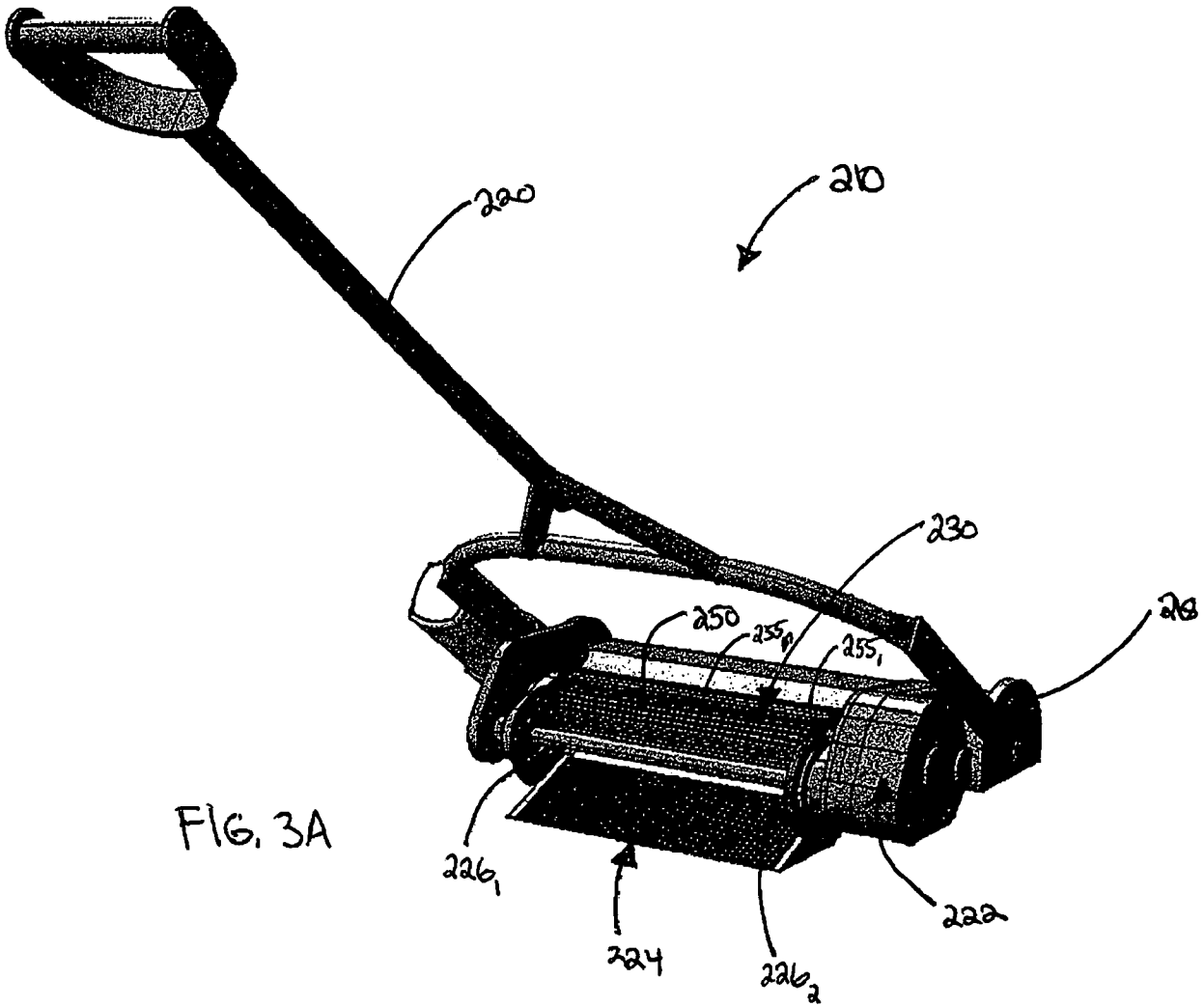
FIG. 3A is a diagrammatic perspective view of an apparatus for removing shingles and shingle fasteners from a roof, in accordance with a third specific example of implementation of the present invention.
Figure 3B:
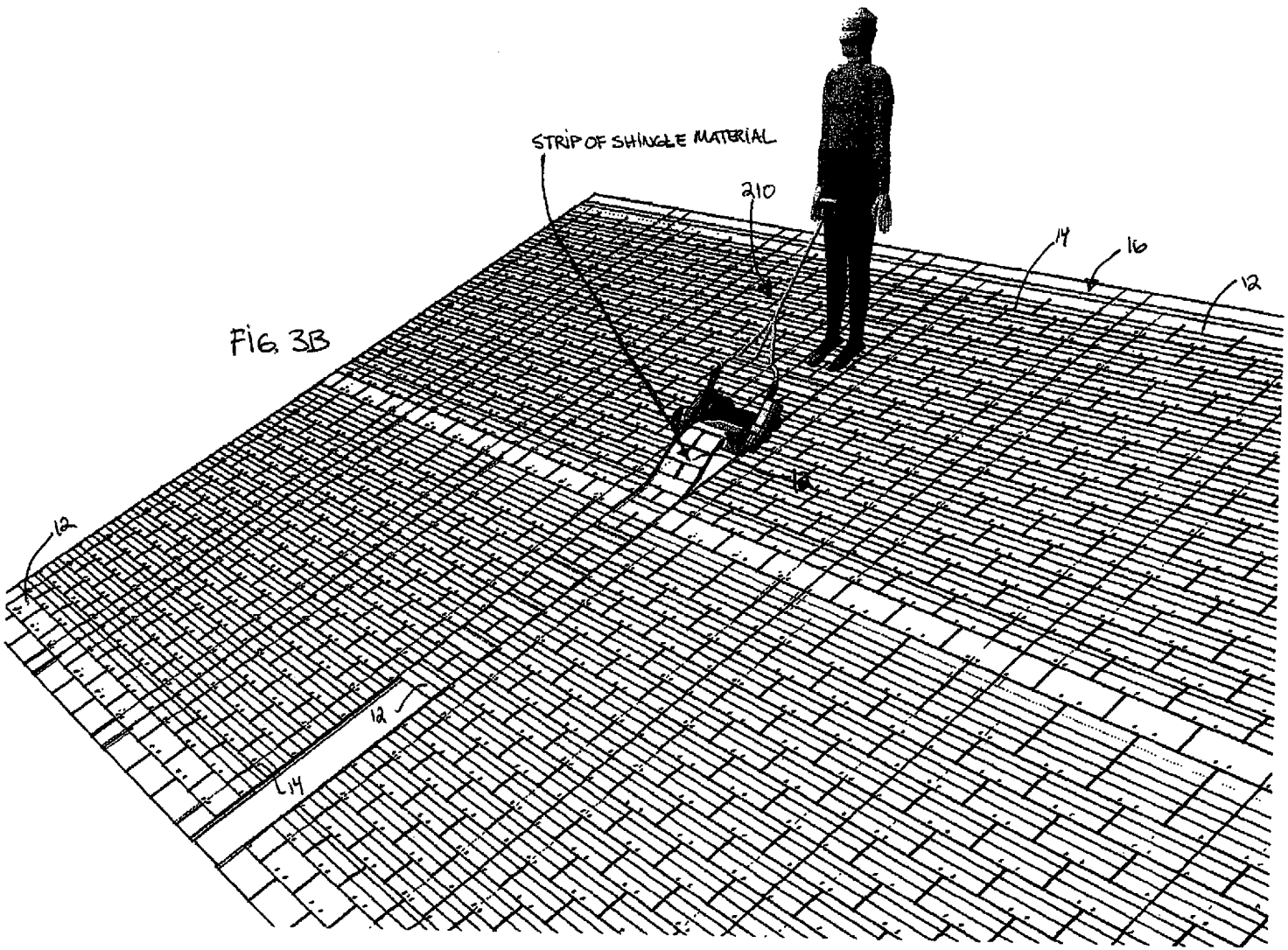
FIG. 3B is a diagrammatic perspective view of the apparatus shown in FIG. 3A in operation on a roof.

FIGS. 3A and 3B show an apparatus 210 for removing shingles $12_1 \ldots 12_n$ and shingle fasteners $14_1 \ldots 14_m$ from a roof 16, in accordance with a third specific example of implementation of the present invention. The apparatus 210 comprises a frame 218, a steering unit 220, a driver unit 222, a stripping unit 224, and a pair of cutters 226, and 2262, and an optional pulling unit 230. The frame 218, the steering unit 220, the driver unit 222, the stripping unit 224, the pair of cutters $226_1$ and $226_2$, and the pulling unit 230 have the same function as the frame 18, the steering unit 20, the driver unit 22, the stripping unit 24, the pair of cutters $26_1$ and $26_2$, and the pulling unit 30, respectively, of the apparatus 10 described previously in connection with FIGS. 1A to 1D.

The apparatus 210 shown in the example of implementation of FIGS. 3A and 3B is smaller in size and thus lighter than the apparatuses 10 and 110 shown in FIGS. 1A to 1F and 2A and 2B. Furthermore, in this specific example of implementation, the pulling unit 130 includes a roller 250 adapted to contact and pull the strip of shingle material as the pulling unit 230 is driven by the driver unit 222. Advantageously, the roller 250 is provided with a plurality of protuberances $255_1 \ldots 255_r$ for gripping the strip of shingle material. In this case, the protuberances $255_1 \ldots 255_r$ extend longitudinally on the roller 250. In addition, the roller 250 is spring-loaded for biasing the roller 250 towards the strip of shingle material in order to maintain contact between the roller 250 and the strip of shingle material. Furthermore, although not shown in FIGS. 3A and 3B, the apparatus 210 can include a pair of traction wheels coupled to the driver unit 22 and operative to move the apparatus 210 on the roof 16. Advantageously, each one of the cutters $226_1$ and $226_2$ can be provided with an extension adapted to contact the roof 16 for providing the functionality of a traction wheel.

In this particular embodiment, similar to that described in connection with FIGS. 2A and 2B, the strip of shingle material is guided by the pulling unit 230 so as to exit through an outlet of the apparatus 210. The strip of shingle material then falls back onto the roof 16, as shown in FIG. 3B, where it can be simultaneously or subsequently rolled up into a roll of shingle material by manual means, for example.

Although various embodiments have been illustrated, this was for the purpose of describing, but not limiting, the invention. Various modifications will become apparent to those skilled in the art and are within the scope of the present invention, which is defined more particularly by the attached claims.

What is claimed is:

1. An apparatus for removing shingles and shingle fasteners from a roof, said apparatus comprising:

a frame;

a driver unit coupled to said frame, said driver unit including at least one motor;

a stripping unit coupled to said driver unit, said driver unit being operative to alternately move said stripping unit between two positions, said stripping unit being adapted to lift shingles off from a roof and to extract shingle fasteners out of the roof as said stripping unit alternately moves between the two positions and said apparatus moves on the roof; and a pair of cutters coupled to said driver unit, said driver unit being operative to drive said pair of cutters, said pair of cutters being adapted to cut shingles lifted off from the roof by said stripping unit to produce a strip of shingle material, the strip of shingle material including at least a portion of a first shingle connected to at least a portion of a second shingle by at least one shingle fastener extracted out of the roof by said stripping unit.

2. An apparatus as defined in claim 1, further comprising a steering unit coupled to said frame for steering said apparatus on the roof.

3. An apparatus as defined in claim 2, wherein said steering unit is adapted to acquire a first configuration and a second configuration, the second configuration being more compact than the first configuration.

4. An apparatus as defined in claim 3, wherein said steering unit is adapted to change from the first configuration to the second configuration by folding onto itself.

5. An apparatus as defined in claim 1, wherein said driver unit being operative to alternately move said stripping unit between two positions comprises said driver unit being operative to reciprocate said stripping unit between the two positions.

6. An apparatus as defined in claim 1, wherein said driver unit being operative to alternately move said stripping unit between two positions comprises said driver unit being operative to alternately pivot said stripping unit between the two positions.

7. An apparatus as defined in claim 1, wherein said driver unit being operative to alternately move said stripping unit between two positions comprises said driver unit being operative to alternately move said stripping unit between the two positions along a path having a rectilinear portion and a curvilinear portion.

8. An apparatus as defined in claim 1, wherein said stripping unit includes a series of teeth generally adjacent and parallel to each other.

9. An apparatus as defined in claim 8, wherein said series of teeth defines a plane at a non-zero angle relative to the roof such as to enable said teeth to reach under and lift shingles off from the roof and extract shingle fasteners out of the roof.

10. An apparatus as defined in claim 1, wherein each cutter of said pair of cutters is a rotary cutter, said driver unit being operative to drive said pair of cutters comprising said driver unit being operative to rotate each rotary cutter.

11. An apparatus as defined in claim 1, wherein said pair of cutters are spaced apart by a certain distance, the strip of shingle material having a width substantially corresponding to the certain distance between said pair of cutters.

12. An apparatus as defined in claim 11, wherein the certain distance between said pair of cutters is such that said stripping unit is positioned between said pair of cutters.

13. An apparatus as defined in claim 1, wherein each cutter of said pair of cutters is selectively positionable relative to said frame for selecting a position at which said pair of cutters begin to cut shingles lifted off from the roof by said stripping unit.

14. An apparatus as defined in claim 1, further comprising a pulling unit coupled to said driver unit, said driver unit being operative to rotate said pulling unit, said pulling unit in rotation being operative to pull the strip of shingle material away from said pair of cutters.

15. An apparatus as defined in claim 14, wherein said pulling unit in rotation being operative to pull the strip of shingle material away from said pair of cutters generates a force for moving said apparatus on the roof.

16. An apparatus as defined in claim 14, wherein said pulling unit is operative to guide the strip of shingle material into a specific direction relative to said frame.

17. An apparatus as defined in claim 14, wherein said pulling unit includes a plurality of arms adapted to sequentially engage and pull the strip of shingle material as the pulling unit rotates.

18. An apparatus as defined in claim 14, wherein said pulling unit includes at least one roller adapted to contact the strip of shingle material, said roller in rotation being operative to pull the strip of shingle material.

19. An apparatus as defined in claim 18, wherein said at least one roller is provided with a plurality of protuberances for engaging the strip of shingle material.

20. An apparatus as defined in claim 14, wherein said pulling unit is spring-loaded for biasing said pulling unit towards the strip of shingle material such as to maintain contact between said pulling unit and the strip of shingle material.

21. An apparatus as defined in claim 1, further comprising a shredding unit coupled to said driver unit, said driver unit being operative to drive said shredding unit, said shredding unit being operative to shred the strip of shingle material.

22. An apparatus as defined in claim 21, wherein said shredding unit includes a plurality of blades connected to a shaft and a barrier defining a plurality of grooves, each groove of said plurality of grooves registering with a respective blade of said plurality of blades, said driver unit being operative to rotate said shaft, rotation of said shaft rotating said plurality of blades into said plurality of grooves so as to shred the strip of shingle material.

23. An apparatus as defined in claim 22, wherein each blade of said plurality of blades is removably connected to said shaft.

24. An apparatus as defined in claim 21, further comprising a shingle material collector removably coupled to said frame and adapted to collect shredded material produced by said shredding unit.

25. An apparatus as defined in claim 1, further comprising at least one traction wheel coupled to said driver unit, said driver unit being operative to drive said at least one traction wheel to move said apparatus on the roof.

26. An apparatus as defined in claim 25, wherein said at least one traction wheel is provided with a plurality of wheel teeth for engaging the roof.

27. An apparatus for removing shingles and shingle fasteners from a roof, said apparatus comprising:

a frame;

driving means coupled to said frame, said driving means including at least one motor;

stripping means coupled to said driving means, for alternately moving said stripping means between two positions, said stripping means being adapted to lift shingles off from a roof and to extract shingle fasteners out of the roof as said stripping means alternately moves between the two positions and said apparatus moves on the roof; and cutting means coupled to said driving means, said driving means being operative to drive said cutting means, said cutting means being adapted to cut shingles lifted off from the roof by said stripping means to produce a strip of shingle material, the strip of shingle material including at least a portion of a first shingle connected to at least a portion of a second shingle by at least one shingle fastener extracted out of the roof by said stripping means.

28. A method for removing shingles and shingle fasteners from a roof, said method comprising:

lifting shingles off from a roof and extracting shingle fasteners out of the roof using a stripping unit alternately moving between two positions; and cutting the shingles lifted off from the roof by the stripping unit to produce a strip of shingle material, the strip of shingle material including at least a portion of a first shingle connected to at least a portion of a second shingle by at least one shingle fastener extracted out of the roof by the stripping unit.

29. A method as defined in claim 28, wherein said lifting shingles off from a roof and extracting shingle fasteners out of the roof comprises lifting shingles off from the roof and extracting shingle fasteners out of the roof starting from a first level on the roof and progressing towards a second level on the roof, the second level being higher than the first level.

* * * * *